US010902818B2

(12) United States Patent
Kim et al.

(10) Patent No.: US 10,902,818 B2
(45) Date of Patent: Jan. 26, 2021

(54) DISPLAY DEVICE AND METHOD OF DRIVING THE SAME

(71) Applicant: LG DISPLAY CO., LTD., Seoul (KR)

(72) Inventors: Dongju Kim, Paju-si (KR); Soondong Cho, Paju-si (KR); Hoon Jang, Paju-si (KR); Jongwoo Kim, Paju-si (KR); Juno Hur, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/503,850

(22) Filed: Jul. 5, 2019

(65) Prior Publication Data

US 2020/0020296 A1 Jan. 16, 2020

(30) Foreign Application Priority Data

Jul. 12, 2018 (KR) ..... 10-2018-0081290

(51) Int. Cl.
*G09G 3/36* (2006.01)

(52) U.S. Cl.
CPC ... *G09G 3/3696* (2013.01); *G09G 2310/0297* (2013.01); *G09G 2330/06* (2013.01)

(58) Field of Classification Search
CPC ..... G09G 3/3696; G09G 3/3275; G09G 2310/0264; G09G 2310/027; G09G 2310/0278; G09G 2310/0297
See application file for complete search history.

(56) References Cited

U.S. PATENT DOCUMENTS

2003/0098833 A1* 5/2003 Sekido ..... G09G 3/3688 345/87
2005/0264548 A1* 12/2005 Okamura ..... G09G 3/3688 345/204
2010/0259523 A1* 10/2010 Huang ..... G09G 3/3688 345/211
2012/0306825 A1 12/2012 Cho
2015/0185937 A1* 7/2015 Lee ..... G09G 3/2092 345/173
2017/0193892 A1 7/2017 Ha
2019/0362666 A1* 11/2019 Chen ..... G06F 3/041

FOREIGN PATENT DOCUMENTS

KR 10-2009-0022052 A 3/2009
KR 10-2012-0133151 A 12/2012
KR 10-2017-0080349 A 7/2017

* cited by examiner

*Primary Examiner* — Sardis F Azongha
(74) *Attorney, Agent, or Firm* — Birch, Stewart, Kolasch & Birch, LLP

(57) ABSTRACT

A display device and a method of driving the same are provided. The display device includes a control signal generator that generates a control signal, a first demultiplexer that time-divides a data voltage from a first channel of a data driver and distributes the data voltage from the first channel to two or more data lines, in response to the control signal, a signal delay part that delays the control signal, and a second demultiplexer that time-divides a data voltage from a second channel of the data driver and distributes the data voltage from the second channel to other two or more data lines, in response to the control signal delayed by the signal delay part.

19 Claims, 12 Drawing Sheets

DISPLAY DEVICE AND METHOD OF DRIVING THE SAME

CROSS-REFERENCE TO RELATED APPLICATIONS

This application claims the priority benefit of Korean Patent Application No. 10-2018-0081290 filed in the Republic of Korea on Jul. 12, 2018, the entire contents of which are incorporated herein by reference for all purposes as if fully set forth herein.

BACKGROUND OF THE INVENTION

Field of the Invention

The present disclosure relates to a display device with demultiplexers DEMUX placed between a data driver and data lines, and a method of driving the same.

Related Art

A display device generally includes a display panel with a pixel array arranged on a screen and a display panel drive circuit for writing the pixel data of input images to the pixels on the display panel. The display panel drive circuit can comprise a data driver that supplies data signals to data lines on the pixel array and a gate driver (or scan driver) that sequentially supplies a gate signal (or scan signal) synchronized with the data signals to gate lines (or scan lines) on the pixel array.

The display device can be subject to EMI (electromagnetic interference) regulations. A variety of technologies are adopted to reduce EMI in display devices, but the EMI standards are hard to meet.

SUMMARY OF THE INVENTION

The present disclosure provides a display device capable of reducing EMI and a method of driving the same.

An embodiment of the present disclosure provides a display device including a control signal generator that generates a control signal, a first demultiplexer that time-divides a data voltage from a first channel of a data driver and distributes the data voltage from a first channel to two or more data lines, in response to the control signal, a signal delay part that delays the control signal, and a second demultiplexer that time-divides a data voltage from a second channel of the data driver and distributes the data voltage from a second channel to other two or more data lines, in response to the control signal delayed by the signal delay part.

An embodiment of the present disclosure provides a display device including a first demultiplexer that time-divides a first and second data voltage sequentially outputted through a first channel of a data driver and distributes the first and second data voltage to first and second data lines, in response to a control signal, a second demultiplexer that time-divides a third and fourth data voltage sequentially outputted through a second channel of the data driver and distributes the third and fourth data voltage to third and fourth data lines, in response to a delayed version of the control signal; and a signal delay part that is connected between a first control signal line for transmitting the control signal and a second control signal line connected to a control node of the second demultiplexer and delays the control signal and applies the same to the control node of the second demultiplexer.

An embodiment of the present disclosure provides a method of driving a display device, the method including generating a control signal for controlling the switch on/off timings of first and second demultiplexers; applying the control signal to a control node of the first demultiplexer and time-dividing a data voltage outputted through a first channel of a data driver and distributing the same to first and second data lines; delaying the control signal; and applying the delayed control signal to a control node of the second demultiplexer and time-dividing a data voltage outputted through a second channel of the data driver and distributing the same to third and fourth data lines.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DESCRIPTION OF EMBODIMENTS

Figure 1:
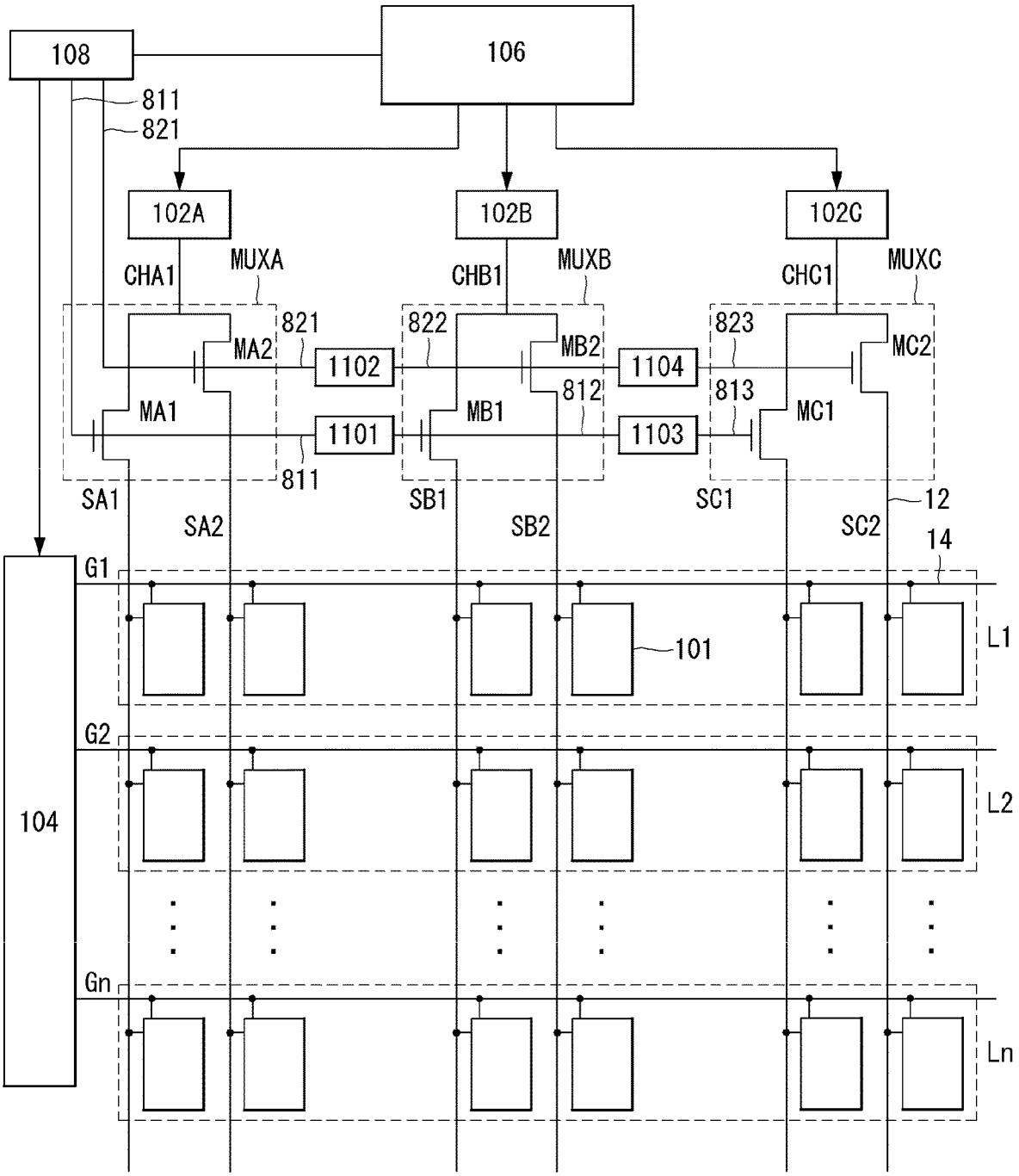
FIGS. 1 and 2 are views showing a display device according to a first embodiment of the present disclosure.

Various aspects and features of the present disclosure and methods of accomplishing them may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring the present disclosure.

When the terms 'comprise', 'have', 'include' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms "on", "over", "under", "next to" and the like, one or more parts may be positioned between the two parts as long as the term "immediately" or "directly" is not used.

It will be understood that, although the terms first, second, etc., may be used to distinguish one element from another element, the functions or structures of these elements should not be limited by these terms.

Features of various exemplary embodiments of the present disclosure may be combined partially or totally. As will be clearly appreciated by those skilled in the art, technically various interactions and operations are possible. Various exemplary embodiments can be practiced individually or in combination.

A display device of the present disclosure can be implemented as a flat-panel display, such as a liquid-crystal display (LCD) and an organic light emitting diode (OLED) display. In the following embodiments, the description focuses on a liquid-crystal display as an example of the flat-panel display, but the present disclosure is not limited thereto and includes other variations.

Touch sensors of the present disclosure can be implemented as on-cell type or add-on type touch sensors arranged on a screen of a display panel. The touch sensors can be implemented as in-cell type touch sensors embedded in the display panel. In the following embodiments, the description focuses on in-cell type touch sensors, but touch sensors of the present disclosure are not limited thereto.

In a display device of the present disclosure, a circuit such as a pixel array, a gate driver, a demultiplexer array, etc. can comprise a plurality of transistors mounted on the display panel. A circuit mounted on the display panel can comprise one or more of an n-channel transistor (NMOS) and a p-channel transistor (PMOS). The transistor is a three-electrode device with gate, source, and drain. The source is an electrode that provides carriers to the transistor. The carriers in the transistor flow from the source. The drain is an electrode where the carriers leave the TFT. That is, the carriers in the transistor flow from the source to the drain. In the case of the n-channel transistor (NMOS), the carriers are electrons, and thus the source voltage is lower than the drain voltage so that the electrons flow from the source to the drain. In the n-channel transistor (NMOS), current flows from the drain to the source. In the case of the p-channel transistor (PMOS), the carriers are holes, and thus the source voltage is higher than the drain voltage so that the holes flow from the source to the drain. In the p-channel transistor (PMOS), since the holes flow from the source to the drain, current flows from the source to the drain. It should be noted that the source and drain of the transistor are not fixed in position. For instance, the source and drain are interchangeable depending on the applied voltage. Therefore, the present disclosure is not limited by the source and drain of the transistor. In the following description, the source and drain of the transistor will be referred to as first and second electrodes.

The voltage of a gate pulse or switch control signal that controls the transistors mounted on the display panel swings between gate-on voltage and gate-off voltage. The gate-on voltage is set higher than the threshold voltage of the transistor, and the gate-off voltage is set lower than the threshold voltage of the transistor. The transistor turns on in response to the gate-on voltage and turns off in response to the gate-off voltage. In the n-channel transistor, the gate-on voltage can be gate-high voltage VGH, and the gate-off voltage can be gate-low voltage VGL. In the p-channel transistor, the gate-on voltage can be gate-low voltage VGL, and the gate-off voltage can be gate-high voltage VGH.

A display device of the present disclosure can comprise a first demultiplexer that time-divides a data voltage outputted through a first channel of the data driver and distributes it to first and second data lines, in response to a control signal, a second demultiplexer that time-divides a data voltage outputted through a second channel of the data driver and distributes it to third and fourth data lines, in response to a delayed version of the control signal, and a signal delay part that is connected between a first control signal line for transmitting the control signal and a second control signal line connected to a control node of the second demultiplexer and delays the control signal and applies it to the control node of the second demultiplexer. Thus, time differences in switch on/off timings can be made between the demultiplexers, thereby reducing EMI in the display device.

Figure 2:
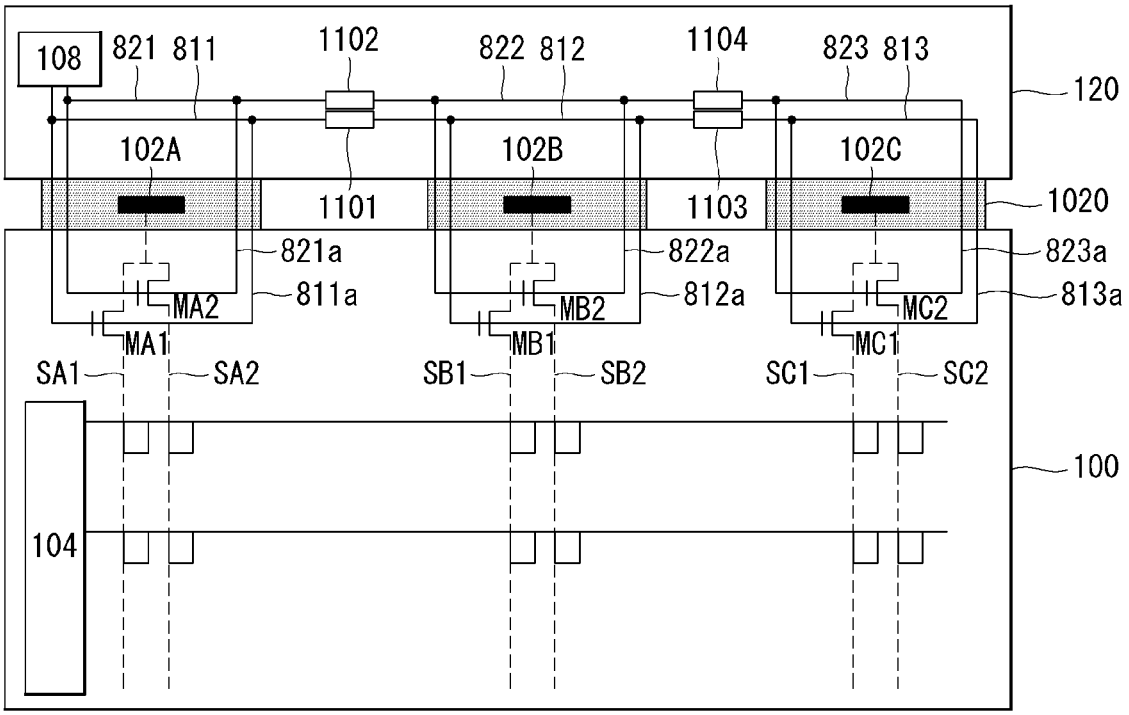
Figure 3:
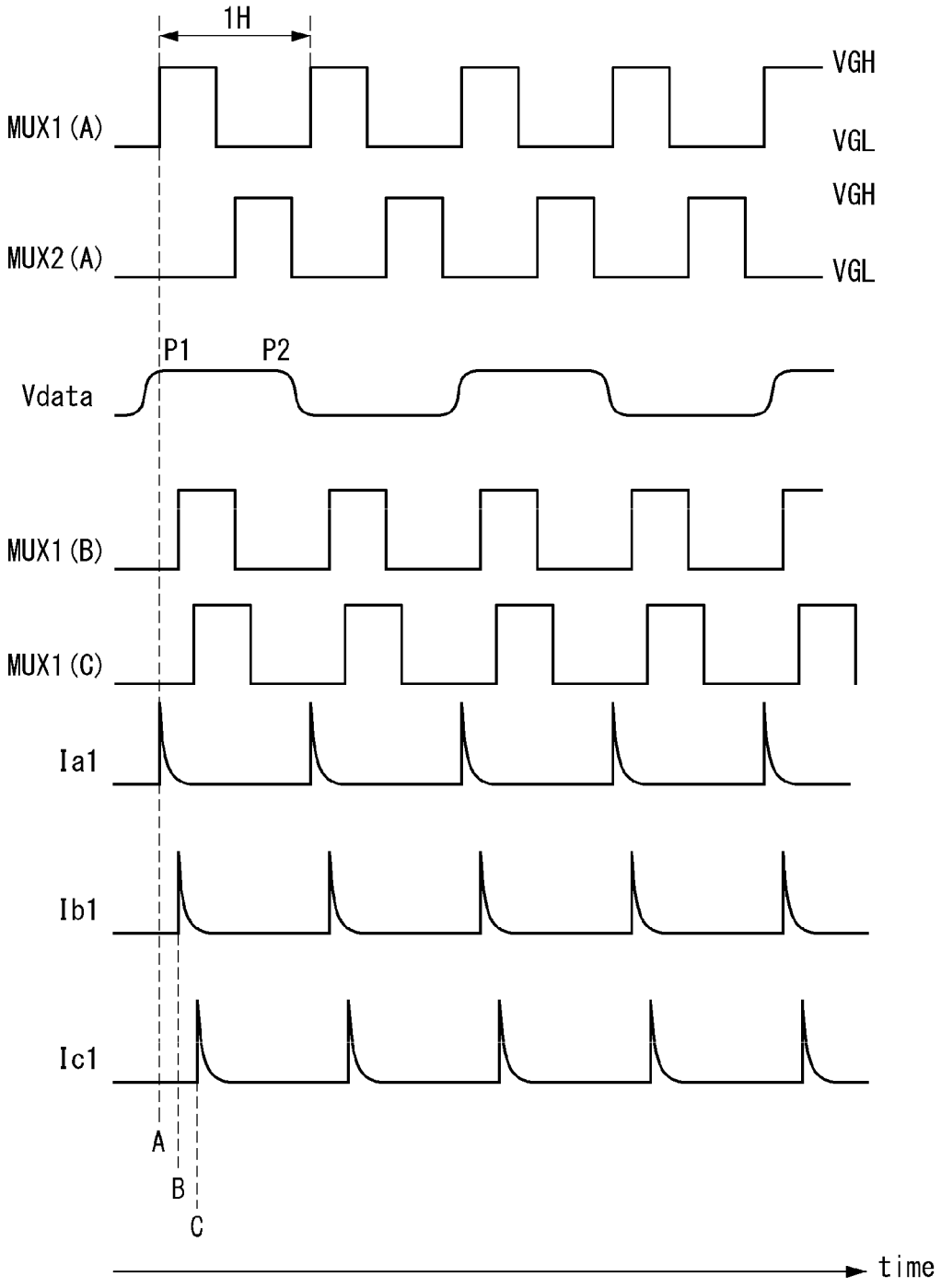
FIG. 3 is a view showing control signals for the demultiplexers shown in FIGS. 1 and 2.

FIGS. 1 and 2 are views showing a display device according to a first embodiment of the present disclosure, and FIG. 3 is a view showing control signals for the demultiplexers shown in FIGS. 1 and 2.

Referring to FIGS. 1 to 3, the display device of the present disclosure comprises a display panel 100 and a display panel drive circuit for writing pixel data on input image to pixels on the display panel 100. The display panel drive circuit comprises a data driver, a demultiplexer array DEMUX array, a gate array 104, etc.

The display panel 100 comprises data lines 12, gate lines 14 intersecting the data lines 12, and a pixel array where pixels are arranged in a matrix defined by the data lines 12 and the gate lines 14. The pixel array implements a screen where an input image is displayed.

The pixels in the pixel array can comprise red (R), green (G), and blue (B) sub-pixels 101 for color representation. Each pixel can further comprise white (W) sub-pixel 101 besides RGB sub-pixels 101. In what follows, pixels can be referred to as sub-pixels.

The pixel array comprises a plurality of pixel lines L1 to Ln. One pixel line comprises pixels arranged in one line in the pixel array of the display panel 100. If the pixel array has a resolution of m*n, the pixel array comprises n pixel lines L1 to Ln. Sub-pixels arranged in one pixel line share a gate line 14. The sub-pixels arranged in one pixel line are connected to different data lines 12. Sub-pixels arranged vertically in the direction of the data lines share the same data line. 1 horizontal period 1H shown in FIG. 3 is a period during which data voltage is supplied to one pixel line of sub-pixels to write pixel data to them. 1 horizontal period is 1 frame period divided by the total number of pixel lines.

The pixel array on the display panel 100 can be divided into a TFT array and a color filter array. The TFT array can be formed on an upper or lower substrate of the display panel 100. The TFT array comprises TFTs (thin-film transistors) formed at the intersections of the data lines 12 and gate lines 14, pixel electrodes that are charged with data voltage, and storage capacitors Cst connected to the pixel electrodes and maintaining data voltage, in order to display an input image.

The color filter array can be formed on the upper or lower substrate of the display panel 100. The color filter array comprises a black matrix, color filters, etc. In a COT (Color Filter On TFT) or TOC (TFT on Color Filter) model, the color filters and the black matrix, along with the TFT array, can be disposed on a single substrate.

A touchscreen comprising touch sensors can be formed on the display panel 100.

The gate driver 104 applies a gate pulse, synchronized with a data voltage Vdata, to a gate line 14 connected to one pixel line of sub-pixels in every horizontal period, thereby selecting one pixel line to which the data voltage Vdata is applied, under control of a timing controller (TCON) 106. The gate driver 104 sequentially selects each pixel line of sub-pixels to which the data voltage Vdata is applied, by sequentially shifting the gate pulse using a shift register.

The data driver comprises one or more source driver integrated circuits (IC) 102A, 102B, and 102C. The source driver ICs 102A, 102B, and 102C each convert the pixel data (digital data) received from the timing controller 106 to analog gamma compensation voltage and produce data voltage Vdata through an output buffer. Although the source driver ICs 102A, 102B, and 102C each comprise a plurality of output channels. In FIG. 1, one output channel CHA1, CHB1, and CHC1 is depicted for each source driver IC 102A, 102B, and 102C, and the other output channels are omitted.

The source driver ICs 102A, 102B, and 102C each comprise a digital circuit part, a digital-to-analog converter (hereinafter, "DAC"), and an output buffer. The digital circuit part latches the pixel data received from the timing controller 106 and supplies it to the digital-to-analog converter (hereinafter, "DAC"). The DAC converts the pixel data to gamma-compensated voltage and produces data voltage. In each of the output channels of the source driver ICs 102A, 102B, and 102C, the output buffer sends the data voltage Vdata from the DAC to the demultiplexer array.

The demultiplexer array comprises a plurality of demultiplexers MUXA, MUXB, and MUXC. The demultiplexers can be connected respectively to the output channels of the source driver ICs 102A, 102B, and 102C. FIG. 1 depicts that, three demultiplexers are respectively connected to the three source driver ICs. Demultiplexers can be connected to the other omitted output channels.

The demultiplexers MUXA, MUXB, and MUXC distribute the data voltage Vdata inputted from the source driver ICs 102A, 102B, and 102C to the data lines 12 under control of the timing controller 106. In the case of 1:N demultiplexers (N is a positive integer equal to or greater than 2), each demultiplexer distributes the data voltage Vdata inputted through one output channel for each source driver IC to N data lines. Thus, the number of output channels for the source driver ICs 102A, 102B, and 102C can be reduced using the demultiplexers. The demultiplexers MUXA, MUXB, and MUXC in FIGS. 1 and 2 are illustrated as being 1:2 demultiplexers which have one input terminal and two output terminals, but not limited to them.

In a display device using 1:N demultiplexers, the source driver ICs 102A, 102B, and 102C output data voltages Vdata for an N number of pixel data during 1 horizontal period 1H. In the case of 1:2 demultiplexers, as shown in FIG. 3, the source driver ICs 102A, 102B, and 102C consecutively output a data voltage for first pixel data and a data voltage for second pixel data through one output channel CHA1, CHB1, and CHC1. In FIG. 3, "P1" denotes the data voltage for first pixel data output from the first output channel CHA1, and "P2" denotes the data voltage for second pixel data output from the first output channel CHA1. Demultiplexer MUXA time-divides a first and second data voltage P1 and P2 sequentially outputted through output channel CH1 and distribute the first and second data voltage P1 and P2 to data lines SA1 and SA2, in response to a control signal MUX1 an MUX2. Demultiplexer MUXB time-divides a third and fourth data voltage sequentially outputted through output channel CH2 and distribute the third and fourth data voltage to data lines SB1 and SB2, in response to a delayed version of the control signal MUX1 and MUX2.

Switch control signals MUX1 and MUX2 and a gate timing control signal, which are outputted from the timing controller 130, can be converted to gate-on voltage VGH and gate-off voltage VGL through a level shifter (LS) 108 and supplied to the gate driver 104. The level shifter 108 converts the low-level voltage of the switch control signals MUX1 and MUX2 and gate timing control signal to the gate-off voltage VGL, and converts the high-level voltage of the gate timing control signal to the gate-on voltage VGH.

The timing controller 106 sends pixel data of input image(s) received from a host system to the source driver ICs 102A, 102B, and 102C. The timing controller 106 controls the display panel drive circuit by receiving timing signals such as a vertical synchronization signal Vsync, horizontal synchronization signal Hsync, data enable signal DE, and main clock MCLK from the host system, in synchronization with the pixel data, and generating a data timing control signal for controlling the operation timing of the data driver, switch control signals MUX1 and MUX2 for controlling the switch on/off timings of the demultiplexers, and a gate timing control signal for controlling the operation timing of the gate driver 104.

As shown in FIG. 2, the timing controller 106 and the level shifter 108 can be mounted on a source printed circuit board (PCB) 120. The demultiplexers MUXA, MUXB, and MUXC and the shift register of the gate driver 104 can be mounted directly on a substrate of the display panel 100.

The host system can be one of the following: a TV (television) system, a set-top box, a navigation system, a personal computer PC, a home theater system, a mobile device, a wearable device, and an in-vehicle infotainment of automobile. However, other examples are possible.

In the present disclosure, the demultiplexers MUXA, MUXB, and MUXC can be driven in a plurality of separate groups, in order to reduce EMI. A first demultiplexer group comprises one or more demultiplexers connected to the first source driver IC 102A. A second demultiplexer group comprises one or more demultiplexers connected to the second source driver IC 102B. A third demultiplexer group comprises one or more demultiplexers connected to the third source driver IC 102C.

The demultiplexers MUXA, MUXB, and MUXC comprise switching elements MA1 to MC2 which are turned on and off in response to the switch control signals MUX1 and MUX2 from the timing controller 106. The switching elements MA1 to MC2 can be implemented as transistors. The switch control signals MUX1 and MUX2 are applied to control nodes of the demultiplexers MUXA, MUXB, and MUXC, i.e., the transistors' gates through control lines 811 to 823.

The first switch control signal MUX1 is applied to the gates of the first switching elements MA1, MB1, and MC1 through a first control line. The first control line can be divided into a (1-1)th control signal line 811, a (1-2)th control signal line 812, and a (1-3)th control signal line 813. The (1-1)th control signal line 811 is connected to a gate of the first switching element MA1 of the first demultiplexer MUXA. The (1-2)th control signal line 812 is connected to a gate of the first switching element MB1 of the second demultiplexer MUXB. The (1-3)th control signal line 813 is connected to a gate of the first switching element MC1 of the third demultiplexer MUXC. The first signal delay part 1101 can be connected between the (1-1)th control signal line 811 and the (1-2)th control signal line 812. The third signal delay part 1103 can be connected between the (1-2)th control signal line 812 and the (1-3)th control signal line 813.

The second switch control signal MUX2 is applied to the gates of the second switching elements MA2, MB2, and MC2 through a second control line. The second control line can be divided into a (2-1)th control signal line 821, a (2-2)th control signal line 822, and a (2-3)th control signal line 823. The (2-1)th control signal line 821 is connected to a gate of the second switching element MA2 of the first demultiplexer MUXA. The (2-2)th control signal line 822 is connected to a gate of the second switching element MB2 of the second demultiplexer MUXB. The (2-3)th control signal line 823 is connected to a gate of the second switching element MC1 of the third demultiplexer MUXC. The second signal delay part 1102 can be connected between the (2-1)th control signal line 821 and the (2-2)th control signal line 822. The fourth signal delay part 1104 can be connected between the (2-2)th control signal line 822 and the (2-3)th control signal line 823.

The timing controller 106 controls the demultiplexers MUXA, MUXB, and MUXC in such a way that there are time differences in switch on/off times between each group, and distributes the currents Ia1, Ib1, and Ic1 flowing through the demultiplexers MUXA, MUXB, and MUXC on the time axis as in A, B, and C as shown in FIG. 3, thereby reducing EMI. To this end, the present disclosure comprises signal delay parts 1101 to 1104 for delaying the switch control signals MUX1 and MUX2 for each demultiplexer group.

As shown in FIGS. 1 and 2, the demultiplexers MUXA, MUXB, and MUXC each comprise a plurality of switching elements that are sequentially turned on within 1 horizontal period 1H. The switching elements can be implemented as n-channel transistors as shown in FIG. 1, but not limited to them. In FIG. 1, SA1 and SA2 are data lines 12 connected to a first demultiplexer MUXA. SB1 and SB2 are data lines 12 connected to a second demultiplexer MUXB. SC1 and SC2 are data lines 12 connected to a third demultiplexer MUXC. In FIG. 1, G1 to Gn are gate lines 14.

The first demultiplexer MUXA, which belongs to the first demultiplexer group comprises switching elements MA1 and MA2. The switching elements MA1 and MA2 are turned on and off in response to the switch control signals MUX1 and MUX2 without delay. During 1 horizontal period 1H of a display period, the switching element MA1 is turned on, and then the switching element MA2 is turned on. The switching elements MA1 and MA2 are alternately turned on and off.

The switching element MA1 is connected between an output channel (hereinafter, referred to as "first output channel") CHA1 of the first source driver IC 102A and a data line SA1. The switching element MA1 is turned on in response to the gate-on voltage VGH of the first switch control signal MUX1 to connect the first output channel CHA1 to the data line SA1. The gate of the switching element MA1 is connected to the (1-1)th control signal line 811 to which the first switch control signal MUX1 is applied. A first electrode of the switching element MA1 is connected to the first output channel CHA1, and a second electrode of the switching element MA1 is connected to the data line SA1.

The switching element MA2 is connected between the first output channel CHA1 and an data line SA2. The switching element MA2 is turned on in response to the gate-on voltage VGH of the second switch control signal MUX2 to connect the first output channel CHA1 to the data line SA2. The gate of the switching element MA2 is connected to the (2-1)th control signal line 821 to which the second switch control signal MUX2 is applied. A first electrode of the switching element MA2 is connected to the first output channel CHA1, and a second electrode of the switching element MA2 is connected to the data line SA2.

The source driver ICs 102A, 102B, and 102C can be mounted on a flexible film of a COF (chip-on-film) 1020. The COF 1020 can be bonded between output terminals of the source PCB 120 and input terminals of the display panel 100. The COF 1020 electrically connects the source PCB 120 and the display panel 100 together. The control signal lines 811 to 823 and the signal delay parts 1101 to 1104 can be formed on the source PCB 120, and the switching elements MA1 to MC2 of the demultiplexers MUXA, MUXB, and MUXC can be formed on a substrate of the display panel 100. To connect the control signal lines 811 to 823 and the switching elements MA1 to MC2, bypass lines 811*a* to 823*a* can be connected to the control signal lines 811 to 823. The bypass lines 811*a* to 823*a* can be formed on the source PCB, the COF 1020, and the substrate of the display panel 100. The bypass lines 811*a* to 823*a* are respectively connected to the gates of the switching elements MA1 to MC2 and the control signal lines 811 to 823 via the source PCB, the COF 1020, and the substrate of the display panel 100.

A (1-1)th bypass line 811*a* is connected to two points on the (1-1)th control signal line 811 in a closed loop, and connected to the gate of the first switching element MA1. Likewise, a (2-1)th bypass line 821*a* is connected to two points on the (2-1)th control signal line 821 in a closed loop, and connected to the gate of the second switching element MA2. A (1-2)th bypass line 812*a* is connected to the (1-2)th control signal line 812 and the gate of the first switching element MB1. A (2-2)th bypass line 822*a* is connected to the (2-2)th control signal line 822 and the gate of the second switching element MB2. A (1-3)th bypass line 813*a* is connected to the (1-3)th control signal line 813 and the gate of the first switching element MC1. A (2-3)th bypass line 823*a* is connected to the (2-3)th control signal line 823 and the gate of the second switching element MC2.

In FIG. 3, MUX1(A) and MUX2(A) are switch control signals applied to the first demultiplexer MUXA. Further, MUX1(B) is a first switch control signal which is delayed for a predetermined amount of time by the signal delay part 1101 and applied to the first demultiplexer MUXA. Also, MUX1(C) is a first switch control signal which is further delayed for a predetermined amount of time by the signal delay part 1103 and applied to the third demultiplexer MUXC. The predetermined amount of time can be several μs.

The first and second signal delay parts 1101 and 1102 delay the switch control signals MUX1 and MUX2 on the (1-1)th and (2-1)th control signal lines 811 and 821 to apply delayed switch control signals MUX1 and MUX2 to the second demultiplexer MUXB, which belongs to the second demultiplexer group, through the (1-2)th and (2-2)th control signal lines 812 and 822.

The second demultiplexer MUXB, which belongs to the second demultiplexer group, comprises switching elements MB1 and MB2. The switching elements MB1 and MB2 are turned on and off in response to the switch control signals MUX1 and MUX2 delayed by the signal delay parts 1101 and 1102. During 1 horizontal period 1H of a display period during which pixel data is written to the pixel array, the switching element MB1 is turned on, and then the switching element MB2 is turned on. The switching elements MB1 and MB2 are alternately turned on and off.

The switching element MB1 is connected between an output channel (hereinafter, referred to as "second output channel") CHB1 of the second source driver IC 102B and a data line SB1. The switching element MB1 is turned on in response to the gate-on voltage VGH of the first switch control signal MUX1 delayed by the first signal delay part 1101 to connect the second output channel CHB1 to the data line SB1. The gate of the switching element MB1 is connected to the (1-2)th control signal line 812 to which the first switch control signal MUX1 is applied. A first electrode of the switching element MB1 is connected to the second output channel CHB1, and a second electrode of the switching element MB1 is connected to the data line SB1.

The switching element MB2 is connected between the second output channel CHB1 and a data line SB2. The switching element MB2 is turned on in response to the gate-on voltage VGH of the second switch control signal MUX2 delayed by the second signal delay part 1102 to connect the second output channel CHB1 to the data line SB2. The gate of the switching element MB2 is connected to the (2-2)th control signal line 822 to which the second switch control signal MUX2 is applied. A first electrode of the switching element MB2 is connected to the second output channel CHB1, and a second electrode of the switching element MB2 is connected to the data line SB2.

The third and fourth signal delay parts 1103 and 1104 delay the switch control signals MUX1 and MUX2 on the (1-2)th and (2-2)th control signal lines 812 and 822 to apply delayed switch control signals MUX1 and MUX2 to the third demultiplexer MUXC, which belongs to the third demultiplexer group, through the (1-3)th and (2-3)th control signal lines 813 and 823.

The third demultiplexer MUXC comprises switching elements MC1 and MC2. The switching elements MC1 and MC2 are turned on and off in response to the switch control signals MUX1 and MUX2 further delayed by the signal delay parts 1103 and 1104. During 1 horizontal period 1H of a display period during which pixel data is written to the pixel array, the switching element MC1 is turned on, and then the switching element MC2 is turned on. The switching elements MC1 and MC2 are alternately turned on and off.

The switching element MC1 is connected between an output channel (hereinafter, referred to as "third output channel") CHC1 of the third source driver IC 102C and a data line SC1. The switching element MC1 is turned on in response to the gate-on voltage VGH of the first switch control signal MUX1 delayed by the third signal delay part 1103 to connect the third output channel CHC1 to the data line SC1. The gate of the switching element MC1 is connected to the (1-3)th control signal line 813 to which the first switch control signal MUX1 is applied. A first electrode of the switching element MC1 is connected to the third output channel CHC1, and a second electrode of the switching element MC1 is connected to the data line SC1.

The switching element MC2 is connected between the third output channel CHC1 and a data line SC2. The switching element MC2 is turned on in response to the gate-on voltage VGH of the second switch control signal MUX2 delayed by the fourth signal delay part 1104 to connect the third output channel CHC1 to the data line SC2. The gate of the switching element MC2 is connected to the (2-3)th control signal line 823 to which the second switch control signal MUX2 is applied. A first electrode of the switching element MC2 is connected to the third output channel CHC1, and a second electrode of the switching element MC2 is connected to the data line SC2.

Figure 4:
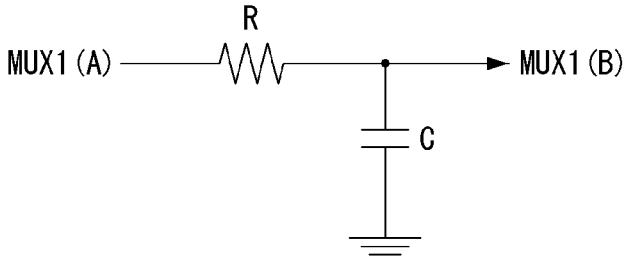
FIGS. 4 and 5 are circuit diagrams showing in detail the signal delay parts shown in FIGS. 1 and 2.
Figure 5:
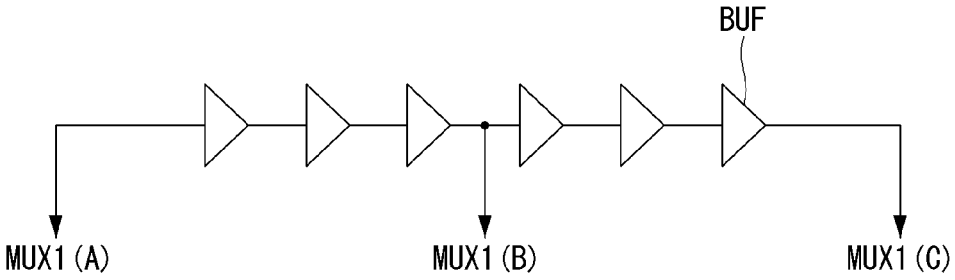

FIGS. 4 and 5 are circuit diagrams showing in detail the signal delay parts.

As shown in FIG. 4, the signal delay parts 1101 to 1104 each can be implemented as an RC delay circuit that comprises a capacitor C connected between a resistor R and a ground voltage source GND. The RC delay circuit can adjust the delay time by a resistance value and/or a capacitance value. As shown in FIG. 5, the signal delay parts 1101 to 1104 each can be implemented as a delay circuit with a plurality of buffers BUF connected in series. The larger the number of buffers connected in series, the longer the delay time.

The source driver ICs 102A, 102B, and 102C and the timing controller 106 can be integrated in a single driver IC in a portable small device such as a mobile system or wearable system.

A touch screen can be disposed on the screen of the display panel 100. The touch screen comprises a plurality of touch sensors disposed on the screen and a touch sensor driver for driving the touch sensors. The touch sensor driver, along with the data driver, can be integrated in a single IC. In what follows, SRIC refers to a driver IC in which the data driver and the touch sensor driver are integrated.

The touch sensors can be implemented as in-cell touch sensors that are embedded in the pixel array. The in-cell touch sensors can be affected by the parasitic capacitance of the pixel array since they are connected to the pixels. To reduce the mutual effects on the pixels and the touch sensors due to the coupling, one frame can be time-divided into a display period for driving the pixels and a touch sensing period for driving the touch sensors. Moreover, a load free driving signal LFD can be applied to the data lines 102 and the gate lines 104, in synchronization with a touch sensor driving signal applied to the touch sensors during the touch sensing period. The load free driving signal LFD is an alternating current signal that has the same phase as the touch sensor driving signal. The load free driving signal LFD can minimize parasitic capacitance which acts as noise in the touch sensor driving signal by reducing the voltage across parasitic capacitors connected to the touch sensors.

Figure 6:
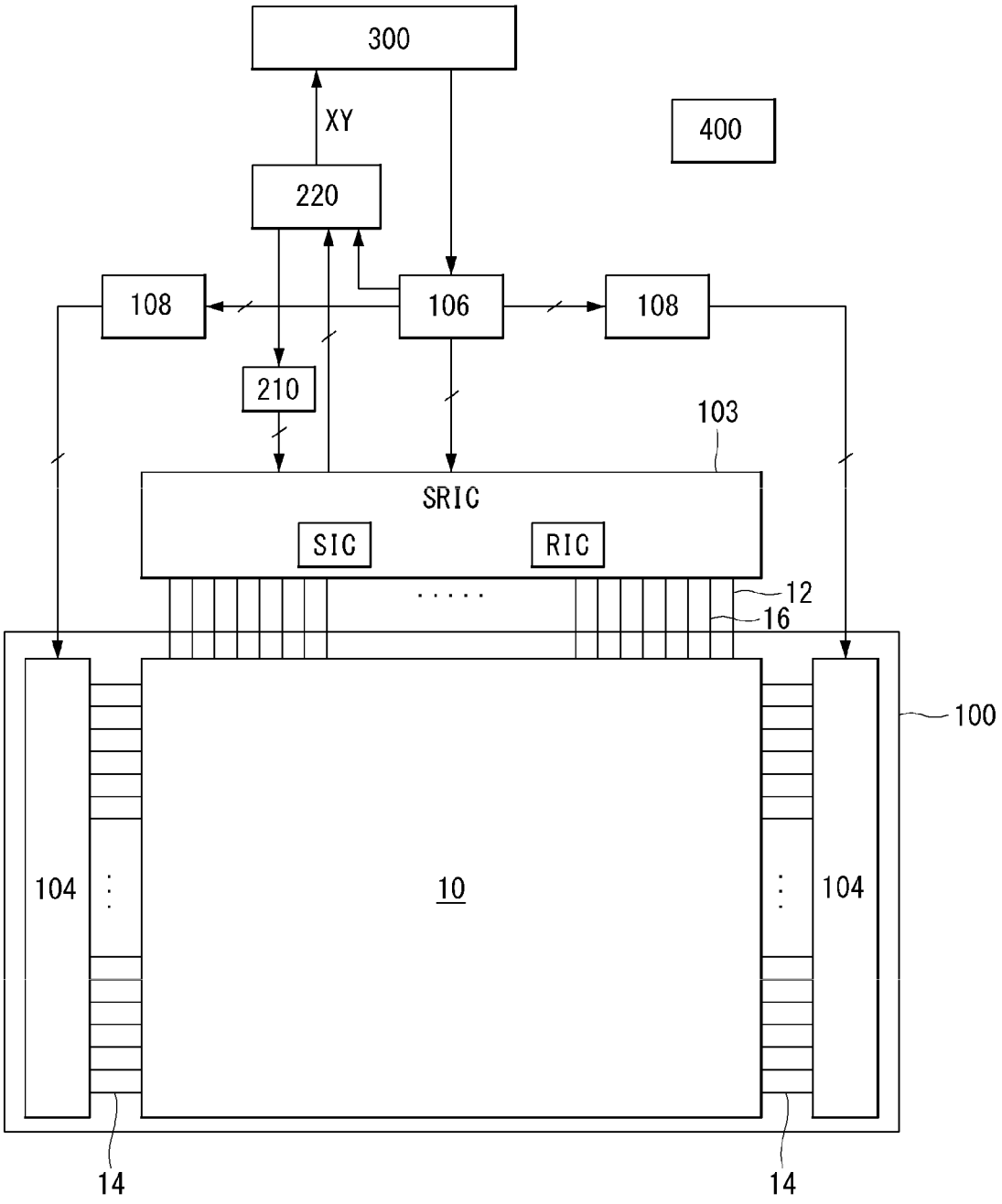
FIGS. 6 to 8 are views showing a display device according to a second embodiment of the present disclosure.
Figure 7:
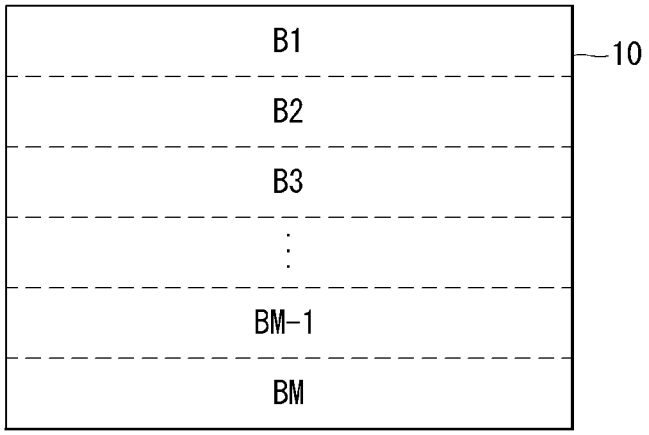
Figure 8:
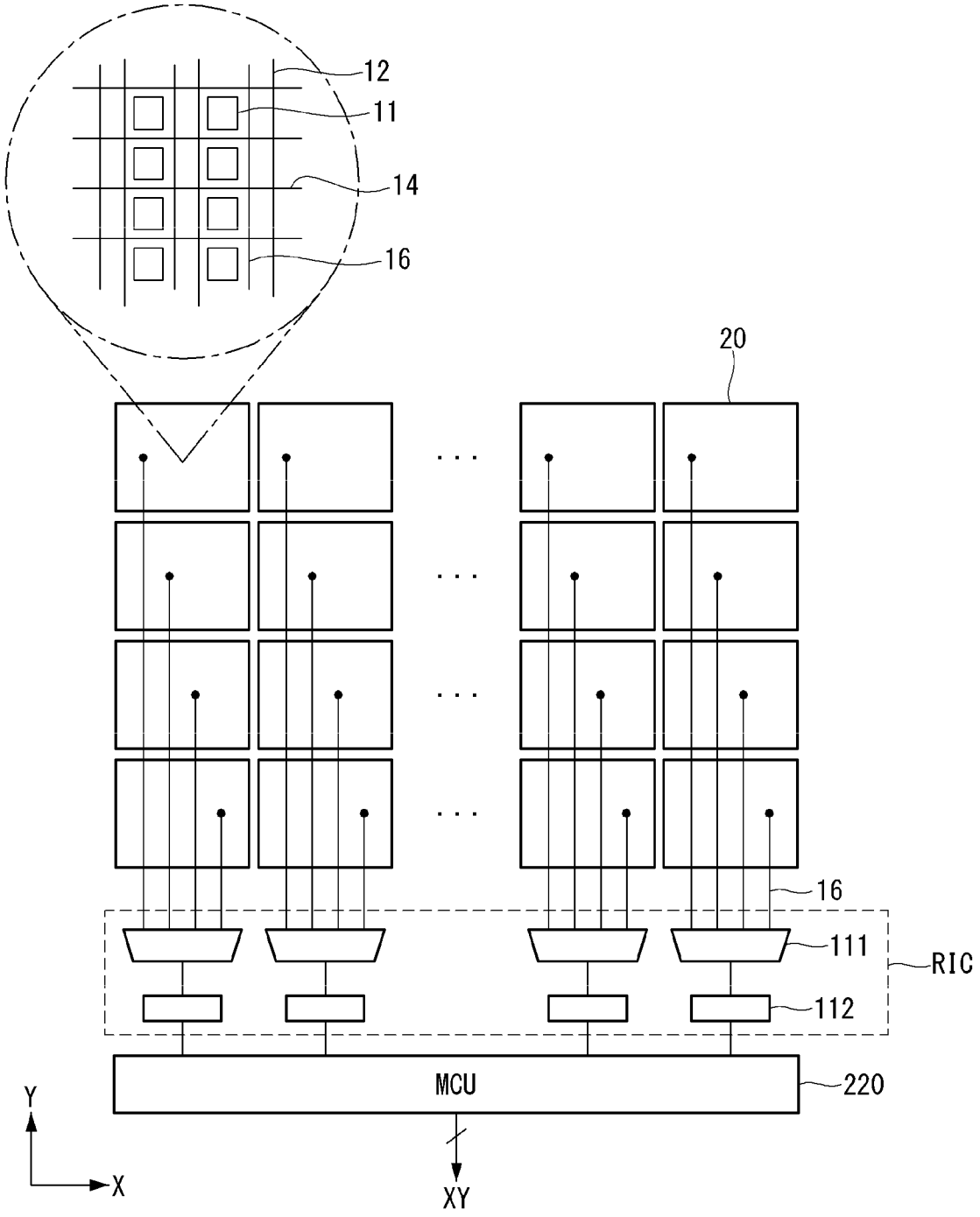

FIGS. 6 to 8 are views showing a display device according to a second embodiment of the present disclosure. FIG. 6 is a block diagram schematically showing the display device. FIG. 7 is a view showing an example in which the pixel array in FIG. 6 is divided into a plurality of blocks. FIG. 8 is a view showing in detail the touch sensors and the touch sensor driver.

Referring to FIGS. 6 to 8, the display device of the present disclosure comprises a display panel 100, an SRIC 103, a touch sensor controller 220, a parasitic capacitance controller 210, a gate driver 104, a timing controller 106, and a level shifter 108.

A pixel array 10 on the display panel 100 implements a screen where an input image is displayed. As shown in FIG. 8, the pixel array 10 comprises touch sensors 20 and sensor lines 16 connected to the touch sensors 20.

The pixels in the pixel array can comprise red (R), green (G), and blue (B) sub-pixels for color representation. Each pixel can further comprise white (W) sub-pixel besides RGB sub-pixels. In what follows, pixels can be referred to as sub-pixels. The touch sensors 20 can have an electrode pattern in which a common electrode is divided into parts of a given size. The common electrode is an electrode that is connected to a plurality of pixels and applies the same common voltage to the pixels. Each touch sensor 20 is connected to a plurality of sub-pixels, and that, during a display period, supplies a common voltage to the pixels and, during a touch sensing period, is driven by the touch sensor driver RIC and senses touch input. This means, e.g., that the touch sensors 20 are common electrodes that supply a common voltage to the pixels during a display period, and, at the same time, sensor electrodes that sense touch input during a touch sensing period. In FIG. 8, reference numeral "11" denotes the pixel electrodes respectively formed in the sub-pixels.

One frame period of the display panel 100 is time-divided into one or more display periods and one or more touch sensing periods. As shown in FIG. 7, the pixel array 10 on the display panel 100 is divided into two or more blocks B1 to BM, and the blocks are driven at different timings. Pixels in one block can be driven during each display period. The blocks B1 to BM are separate driving regions that do not need to be physically separated on the display panel 100 but driven in a time-division under control of the timing controller 106. The pixel array 10 is divided and driven at different timings, with touch sensing periods in between, since it is driven during display periods. The pixels on the pixel array 10 are not driven during the touch sensing periods but remain just as they were before.

The pixels in the blocks B1 to BM are divided and driven at different timings, with touch sensing periods in between. For example, the pixels in the first block B1 are driven during a first display period to write the current frame data to the pixels, and then touch input is sensed on the entire screen during a first touch sensing period. Following the first touch sensing period, the pixels in the second block B2 are driven during a second display period to write the current frame data to the pixels. Then, touch input is sensed on the entire screen during a touch sensing period. Here, the touch input includes direct touch input, proximity touch input, fingerprint touch input, etc. from a finger or stylus pen. In such a method of driving the touch sensors, the touch report rate can be made faster than the frame rate of the screen. The frame rate is the frequency at which frame data is updated. The frame frequency is 60 Hz in the NTSC (National Television Standards Committee) system and 50 Hz in the PAL (Phase-Alternating Line) system. The touch report rate is the frequency at which the coordinates of touch input on the entire screen are generated. In the present disclosure, the screen can be divided and driven in a preset number of blocks, and the touch sensors are driven between the display periods to generate touch input coordinate, so that the touch report rate becomes two times faster than the frame rate of the screen, thereby increasing touch sensitivity.

The pixel array on the display panel 100 can be divided into a TFT array and a color filter array. The TFT array can be formed on an upper or lower substrate of the display panel 100. The TFT array comprises TFTs (thin-film transistors) formed at the intersections of the data lines 12 and gate lines 14, pixel electrodes 11 that are charged with data voltage, and storage capacitors Cst connected to the pixel electrodes 11 and maintaining data voltage, in order to display an input image. The TFT array comprises sensor lines 16 and electrodes of the touch sensors 20 connected to the sensor lines 16.

The color filter array can be formed on the upper or lower substrate of the display panel 100. The color filter array comprises a black matrix, color filters, etc. In a COT (Color Filter On TFT) or TOC (TFT on Color Filter) model, the color filters and the black matrix, along with the TFT array, can be disposed on a single substrate.

The touch sensors 20 can be implemented as capacitance touch sensors—for example, mutual capacitance touch sensors and self-capacitance touch sensors. The self-capacitance touch sensors are formed along a single layer of conductive lines formed in one direction. The mutual capacitance touch sensors are formed between two conductive lines intersecting each other. Although FIG. 8 illustrates self-capacitance touch sensors, the touch sensors of the present disclosure are not limited to them. The touch sensors 20 are connected to the SRIC 103 through the sensor lines 16.

The SRIC 103 comprises a data driver SIC that supplies a data voltage to the data lines 12 during a display period and a touch sensor driver RIC that is connected to the touch sensors 20 through the sensor lines 16 and drives the touch sensors during a touch sensing period.

As shown in FIG. 1, the SRIC 103 is connected to the data lines 12 through the demultiplexers MUXA, MUXB, and MUXC and supplies the data voltage from the data driver SIC to the data lines 12 through the demultiplexers MUXA, MUXB, and MUXC during a display period. As shown in FIG. 8, the touch sensor driver RIC of the SRIC 103 is connected to sensor lines 16 through multiplexers 111 and supplies a load free driving signal LFD to the sensor lines 16 during a touch sensing period.

During a display period, a digital circuit of the data driver SIC receives and latches pixel data (digital data) from the timing controller 106 and supplies it to the DAC. The DAC converts the pixel data to gamma-compensated voltage and produces data voltage. The data voltage outputted from the data driver SIC is supplied to the data lines 12 through the demultiplexers MUXA, MUXB, and MUXC shown in FIG. 1.

Figure 12:
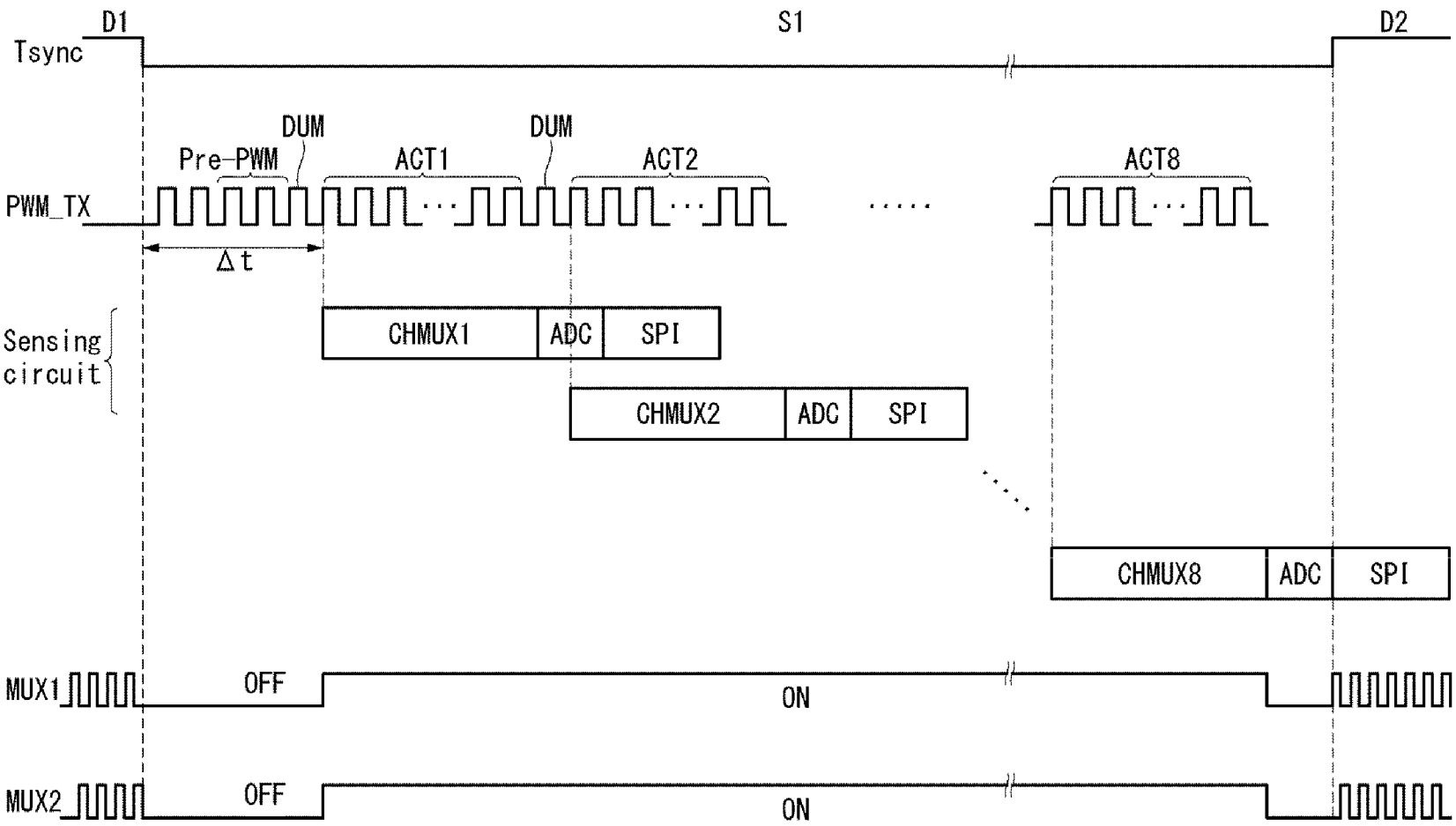
FIG. 12 is a waveform diagram showing in detail a sensor driving signal during a touch sensing period according to an example of the present disclosure.

During a touch sensing period, the touch sensor driver RIC of the SRIC 103 supplies a load free driving signal LFD to the sensor lines 16 in response to a touch sensor driving signal received from the touch sensor controller 220 to supply an electric charge to the touch sensors 20, thereby driving the touch sensors 20. In FIG. 12, "PWM_TX" denotes a touch sensor driving signal. The touch sensor driver RIC outputs touch raw data which represents changes in the capacitance of each touch sensor 20 before and after touch input during a touch sensing period.

As shown in FIG. 8, the touch sensor driver RIC comprises multiplexers 111 and sensing circuits 112. The multiplexers 111 select sensor lines 16 to be connected to the sensing circuits 112 under control of the touch sensor controller 220. The multiplexers 111 can supply a common voltage Vcom during a display period, under control of the touch sensor controller 220. The multiplexers 111 sequentially connect the sensor lines 16 to the channels of the sensing circuits 112, thereby reducing the number of channels in the sensing circuits 112.

Figure 13:
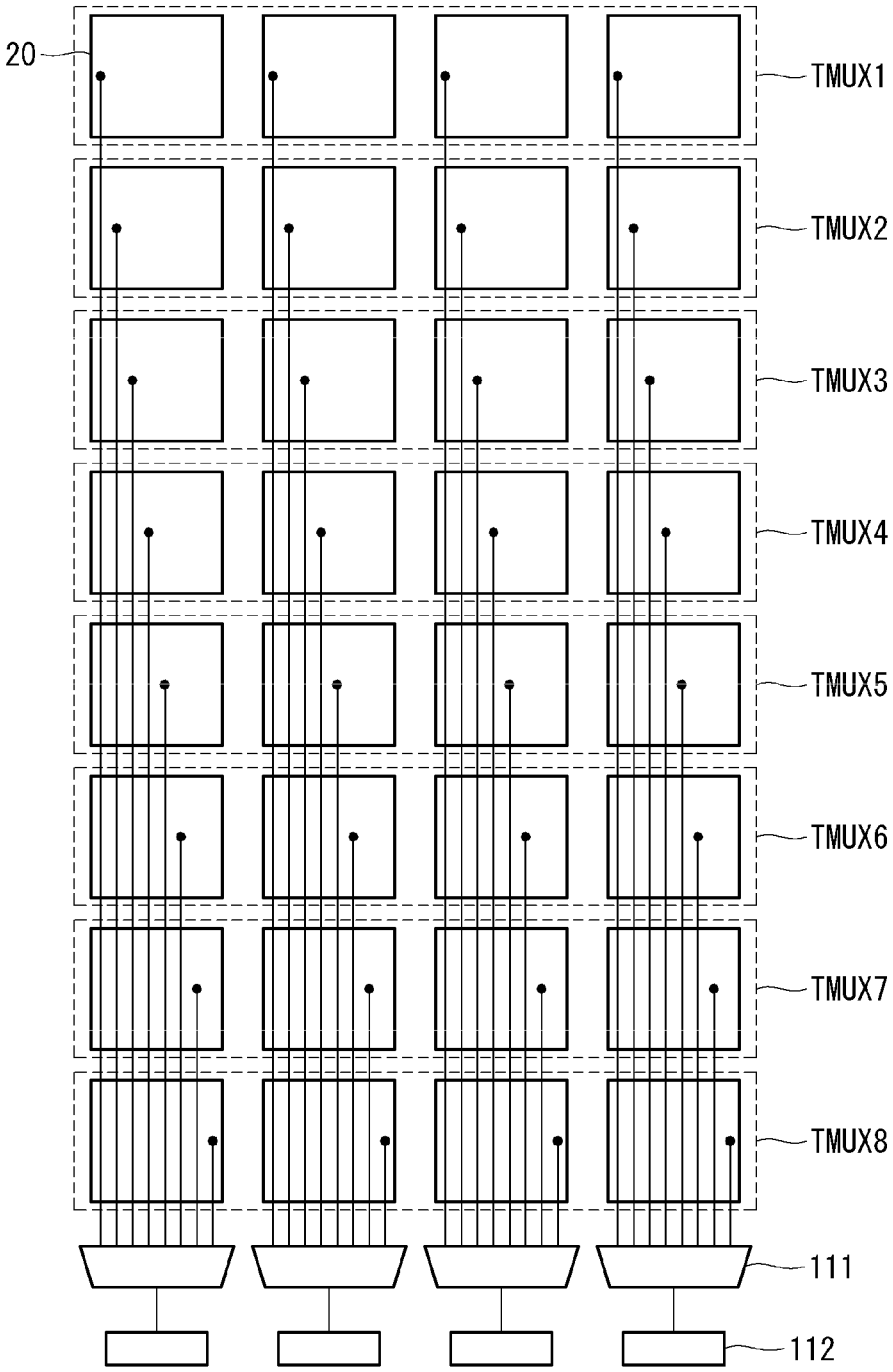
FIG. 13 is a view showing an example of touch sensor groups according to an example of the present disclosure.

The sensing circuits 112 charge the touch sensors 20 with an electric charge by supplying a load free driving signal LFD from the parasitic capacitance controller 210 to the touch sensors 20 through the multiplexers 111 and the sensor lines 16 during a touch sensing period. The sensing circuits 112 amplify and integrate the amount of charge in the touch sensors 20 received from the sensor lines 16 connected through the multiplexers 111, convert the integrated value to digital data, and sense changes in capacitance before and after touch input. To this end, the sensing circuits 112 each comprise an amplifier for amplifying a touch sensor signal received from the touch sensors 20, an integrator for accumulating the output voltage of the amplifier, and an analog-to-digital converter (hereinafter, "ADC") for converting the voltage of the integrator to digital data. The digital data outputted from the ADC is touch data that indicates changes in the capacitance of the touch sensors 20 before and after touch input, which is transmitted to the touch sensor controller 220. The sensing circuits 112 can sequentially drive the touch sensors 20 in touch sensor groups TMUX1 and TMUX2 of a predetermined size under control of the touch sensor driver 220, as shown in FIG. 13.

The touch sensor controller 220 generates the coordinates XY of each touch input by comparing the touch data received from the touch sensor driver RIC with a preset threshold and detecting touch data higher than the threshold. The touch sensor controller 220 transmits the coordinates XY of each touch input to a host system 300. The touch sensor controller 220 supplies a touch sensor driving signal PWM_TX, an ADC clock, etc. and supplies them to the touch sensor driver RIC. The touch sensor controller 220 can be implemented as a micro control unit MCU, but not limited to it.

Figure 9:
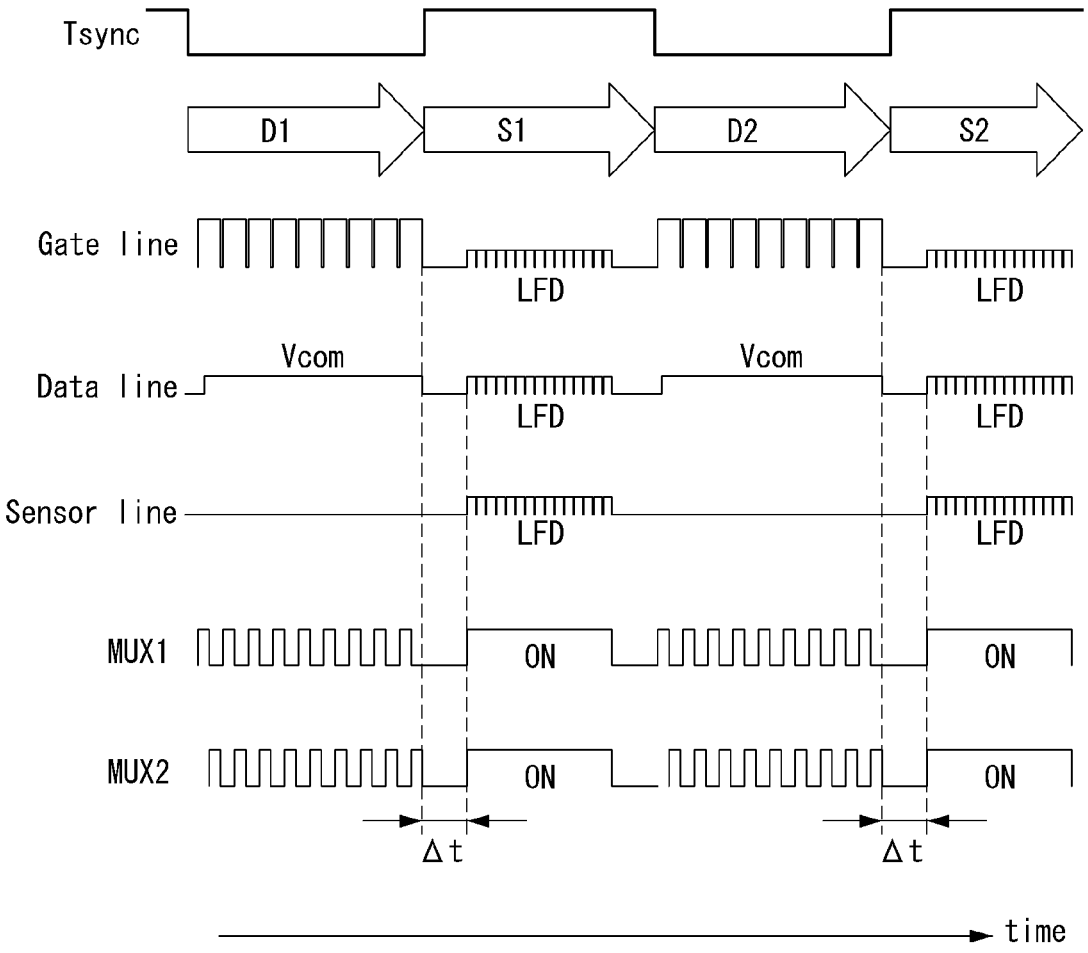
FIGS. 9 and 10 are waveform diagrams showing a method of driving the pixels and the touch sensors according to an example of the present disclosure.
Figure 10:
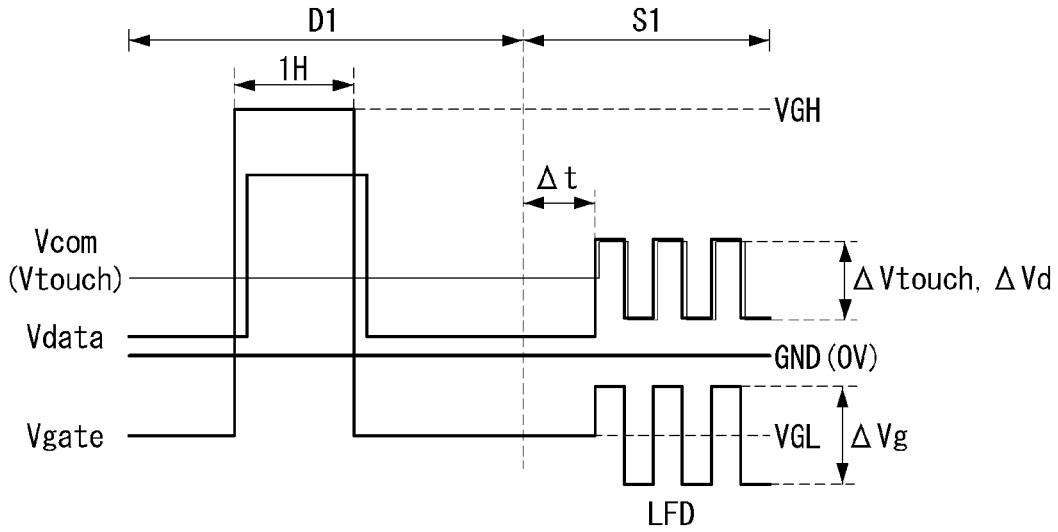

The parasitic capacitance controller 210 improves the signal-to-noise ratio (hereinafter, "SNR") of a touch sensor signal by minimizing the parasitic capacitance between the touch sensors 20 and the pixels during a touch sensing period. To this end, the parasitic capacitance controller 210 generates a load free driving signal LFD and supplies it to the touch sensor driver RIC, in response to the touch sensor driving signal PWM_TX from the touch sensor controller 220. As shown in FIGS. 9 and 10, the load free driving signal LFD is applied to the data lines 12, the gate lines 14, and the sensor lines 16. The load free driving signal LFD applied to the sensor lines 16 supply an electric charge to the touch sensors 20, and minimize the parasitic capacitance between neighboring sensor lines 16.

The gate driver 104 comprises a shift register that outputs a gate pulse in response to a gate timing control signal inputted through the level shifter 108. The shift register can be formed directly on a substrate of the display panel 100, along with the TFT array of the pixel array and in the same process. The gate driver 104 sequentially supplies a gate pulse to the gate lines 14 by using a shift register.

A power circuit 400 generates DC (direct current) power required to drive the display panel 100 by using a DC-to-DC converter. The DC-to-DC converter comprises a charge pump, a regulator, a buck converter, a boost converter, etc. The power circuit 400 can be implemented as a power integrated circuit (PIC). The power circuit 400 outputs DC voltage, for example ΔVDD, VGH, VGL, and Vcom, which is required to drive the pixels and touch sensors on the display panel 100. ΔVDD (e.g., 1.8 V) is voltage for data receiving circuits and digital circuits, and is also used as analog voltage for the touch sensor driver RIC. In the touch sensor driver RIC, ΔVDD is used as bias and operating voltage for the ADC.

The timing controller 106 sends a pixel data of input image received from the host system 300 to the data driver RIC of the SRIC 103. The timing controller 106 receives timing signals such as a vertical synchronization signal Vsync, horizontal synchronization signal Hsync, data enable signal DE, and main clock MCLK, in synchronization with the pixel data, and generates a data timing control signal for controlling the operation timing of the data driver SIC, switch control signals MUX1 and MUX2 for controlling the switch on/off timings of the demultiplexers shown in FIG. 1, and a gate timing control signal for controlling the operation timing of the gate driver 104.

The timing controller 106 generates a synchronization signal Tsync for synchronizing the SRIC 103 and the gate driver 104 based on the vertical synchronization signal Vsync. As shown in FIG. 9, the high level of the synchronization signal Tsync can define a touch sensing period S1 and S2, and the low level of the synchronization signal Tsync can define a display period D1 and D2, but they are not limited thereto. The synchronization signal Tsync is supplied to the touch sensor controller 220.

FIGS. 9 and 10 are waveform diagrams showing a method of driving the pixels and the touch sensors according to an example of the present disclosure.

Referring to FIGS. 9 and 10, one frame period can be time-divided into one or more display periods D1 and D2 and one or more touch sensing periods S1 and S2. At a display frame rate of 60 Hz, one frame period is approximately 16.7 ms. One touch sensing period S1 or S2 is allocated between the display periods D1 and D2.

The data driver SIC of the SRIC 103 and the gate driver 104 write the current frame data to the pixels in the first block B1 during a first display period D1 to update an image reproduced in the first block with the current frame data. During the first display period D1, the pixels in the other block B2 besides the first block B1 maintains the previous frame data. During the first display period D1, the touch sensor driver RIC supplies the touch sensors 20 with a common voltage Vcom which is a reference voltage for the pixels.

During a first touch sensing period S1, the touch sensor driver RIC of the SRIC 103 can sequentially drive all the touch sensors 20 within the screen in the touch sensor groups TMUX1 and TMUX2 to sense touch input. Touch data outputted from the touch sensor driver RIC can be transmitted to the touch sensor controller 220 through a serial peripheral interface (SPI). The touch sensor controller 220 analyzes the touch data, generates touch report data containing coordinate information and identifier information (ID) of each touch input, and transmits the touch report data to the host system 300.

During a second display period D2, the data driver SIC of the SRIC 103 and the gate driver 104 write the current frame data to the pixels in the second block B2 to update an image reproduced in the second block B2 with the current frame data. During the second display period D2, the pixels in the other block B1 besides the second block B2 maintains the previous frame data. During the second display period D2, the touch sensor driver RIC supplies the touch sensors 20 with a common voltage Vcom which is also a common voltage for the pixels.

During a second touch sensing period S2, the touch sensor driver RIC of the SRIC 103 sequentially drives all the touch sensors 20 within the screen in the MUX blocks MUX1 and MUX2 to sense touch input. Touch data outputted from the touch sensor driver RIC can be transmitted to the touch sensor controller 220 through the SPI. The touch sensor controller 220 analyzes the touch data, generates touch report data containing coordinate information and identifier information (ID) of each touch input, and transmits the touch report data to the host system 300.

Since the touch sensors 20 are connected to the pixels, the parasitic capacitance between the touch sensors 20 and the pixels is large. Such a parasitic capacitance causes a degradation of the SNR of a touch sensor signal.

During a display period D1 and D2, pixel driving signals Vcom, Vdata, and Vgate are supplied to the pixels. Vcom is a common voltage supplied to touch sensor electrodes, that is, common electrodes, along the sensor lines 16 during the display period. Vdata is a data voltage for an input image that is supplied to the data lines 12 during the display period D1 and D2. Vgate is the voltage of a gate pulse supplied to the gate lines 14 during the display period D1 and D2. During a touch sensing period S1 and S2, a load free driving signal LFD shown in FIG. 9 is applied to the data lines 12, the gate lines 14, and the sensor lines 16. The load free driving signal LFD drives the touch sensors 20, and minimizes the parasitic capacitance between the pixels and the touch sensors 20.

During touch sensing periods S1 and S2, the SRIC 103 supplies a load free driving signal LFD from the parasitic capacitance controller 210 to the data lines 12 and the sensor lines 16. During the touch sensing periods S1 and S2, the gate driver 104 supplies a load free driving signal LFD from the parasitic capacitance controller 210 to the gate lines 14.

The voltage Vtouch of the load free driving signal LFD applied to the sensor lines 16 is equal to the driving voltage of the touch sensors 20. In FIG. 10, $\Delta Vtouch=\Delta Vd=\Delta Vg$. $\Delta Vd$ denotes the voltage of the load free driving signal LFD applied to the data lines 12, $\Delta Vg$ is the voltage of the load free driving signal LFD applied to the gate lines 12. Thus, during the touch sensing periods S1 and S2, there is no voltage difference between the two ends of parasitic capacitors between the data lines 12 and the touch sensors 20, parasitic capacitors between the gate lines 14 and the touch sensors 20, and parasitic capacitors between the sensor lines 16. Thus, parasitic capacitance can be minimized.

In a transition from a display period D1 or D2 to a touch sensing period S1 or S2, a stabilization time $\Delta td$ can be required until the waveform and voltage of the load free driving signal LFD become stable. The stabilization time $\Delta td$ can be adjusted according to the parasitic capacitance of the display panel 100 and the touch sensor driving voltage Vtouch. The touch sensor driver RIC is driven after the stabilization time $\Delta td$ to convert a touch sensor signal to digital data and output touch data.

The load free driving signal LFD needs to be applied in the same phase across the data lines 12, gate lines 14, and sensor lines 16 in order to minimize the effects of parasitic capacitance on the touch sensors. If the switch on/off timings of the demultiplexers MUXA, MUXB, and MUXC are progressively delayed by the switch control signals MUX1 and MUX2, there can be a phase difference between the load free driving signal LFD applied to the data lines 12 and the load free driving signal LFD applied to the gate lines 14 and sensor lines 16, but this concern can be ignored. This is because, during a touch sensing period, the switching elements MA1 to MC2 of all the demultiplexers MUXA, MUXB, and MUXC are kept in the on state in order to apply the load free driving signal LFD simultaneously to all the data lines 12. Therefore, in the present disclosure, during the touch sensing period, the load free driving signal LFD applied to the data lines 12 have the same phase as the load free driving signal LFD applied to the gate lines 14 and sensor lines 16.

Figure 11:
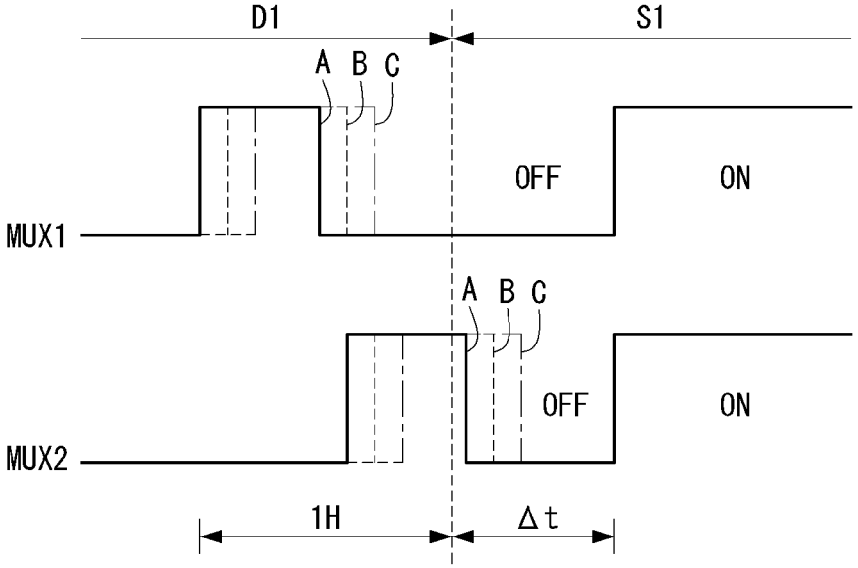
FIG. 11 is a waveform diagram showing switching control signals for the demultiplexers at the boundary between a display period and a touch sensing period according to an example of the present disclosure.

The switching elements MA1 to MC2 of the demultiplexers MUXA, MUXB, and MUXC are alternately turned on and off in every horizontal period in response to the switch control signals MUX1 and MUX2 and time-divide a data voltage Vdata and supply it to two data lines 12. Although the switch control signals MUX1 and MUX2 are delayed by the signal delay parts 1101 to 1104 to reduce EMI, the falling edge of the last switch control signal does not exceed the stabilization time $\Delta td$ at the beginning of the touch sensing periods S1 and S2. In other words, the falling edge of the last switch control signal needs to be preferably within the display periods D1 and D2, and is present within the stabilization time $\Delta td$ at the beginning of the touch sensing periods S1 and S2 even if the amount of delay of the switch control signals is large as shown in FIG. 11. In FIGS. 11, A, B and C denote switch control signals MUX1 and MUX3 sequentially delayed in order to distribute current on the time axis.

Since the touch sensor driver RIC is driven after the stabilization time $\Delta td$, the switch on/off timings of the demultiplexers MUXA, MUXB, and MUXC do not affect the touch sensing operation. During the stabilization time $\Delta td$, the touch sensor driver RIC does not operate but is on standby, and therefore generates no power consumption. With no power consumption generated by the touch sensor driver RIC, the effect of the parasitic capacitance of the display panel 100 can be ignored.

FIG. 12 is a waveform diagram showing in detail a sensor driving signal PWM_TX during a touch sensing period according to an example of the present disclosure. FIG. 13 is a view showing an example of touch sensor groups TMUX1 to TMUX8 of touch sensors according to an example of the present disclosure. Although FIG. 13 illustrates an example in which a touchscreen is divided and driven in eight groups at different times, the number of groups can vary with the number of touch sensors and the method of driving the touchscreen.

Referring to FIGS. 12 and 13, the touch sensor controller 220 generates a sensor driving signal PWM_TX during a touch sensing period S1. The sensor driving signal PWM_TX comprises a pre-PWM signal Pre-PWM, a dummy signal DUM, and a channel activation signal ACT1 to ACT8.

Immediately after a transition from a display period D1 to the touch sensing period S1, pixel driving signals Vcom, Vdata, and Vgate are changed into a load free driving signal LFD. At the beginning of the touch sensing period S1, a stabilization time $\Delta t$ can be required until the waveform and voltage of the load free driving signal LFD become stable. During the stabilization time $\Delta t$, the pre-PWM signal Pre-PWM and the dummy signal DUM can be generated.

The touch sensor driver RIC of the SRIC 103 is not driven during the stabilization time $\Delta t$ during which the pre-PWM signal Pre-PWM and the dummy signal DUM are generated. During the stabilization time $\Delta t$, the switching elements of all channels of the multiplexers 111 are turned off, and therefore the sensor lines 16 are not connected to the channels of the sensing circuits 112. The pre-PWM signal Pre-PWM and the dummy signal DUM can have the same duty ratio and phase as the load free driving signal LFD, but not limited thereto.

The touch sensor driver RIC is driven during channel activation periods CHMUX1 to CHMUX8 after the stabilization time. During the channel activation periods CHMUX1 to CHMUX8, the touch sensor driver RIC connects the channels of the sensing circuits 112 on a per-group basis to the sensor lines 16 through the multiplexers 111 to supply the load free driving signal LFD to the touch sensors 20 and drive the touch sensors 20.

During the first channel activation period CHMUX1, the multiplexers 111 connect the sensor lines 16, connected to the touch sensors 20 in the first touch sensor group TMUX1, simultaneously to the sensing circuits 112. During the first channel activation period CHMUX1, the sensing circuits 112 simultaneously drive the touch sensors 20 in the first touch sensor group TMUX1 to amplify and integrate a signal received from the touch sensors 20, convert the integrated value to digital data, i.e., touch data, through the ADC, and send it to the touch sensor controller 220 through the SPI.

Next, during the second channel activation period CHMUX2, the multiplexers 111 connect the sensor lines 16, connected to the touch sensors 20 in the second touch sensor group TMUX2, simultaneously to the sensing circuits 112. During the second channel activation period CHMUX2, the sensing circuits 112 simultaneously drive the touch sensors 20 in the second touch sensor group TMUX2 to amplify and integrate a signal received from the touch sensors 20, convert the integrated value to digital data through the ADC, and send it to the touch sensor controller 220 through the SPI. During the transmission time (ADC in FIG. 12) of the touch data obtained during the second channel activation period CHMUX2, the reception, amplification, and integration of a signal from the touch sensors 20 in the second touch sensor group TMUX2 can be performed simultaneously, as shown in FIG. 12. A dummy signal DUM can be generated between the first channel activation period CHMUX1 and the second channel activation period CHMUX2.

In this way, during the touch sensing period S1, the touch sensor driver RIC can drive the touch sensors 20 in the first to eighth touch sensor groups TMUX1 to TMUX8 on a per-group basis in a time-division and sense touch input.

Figure 14:
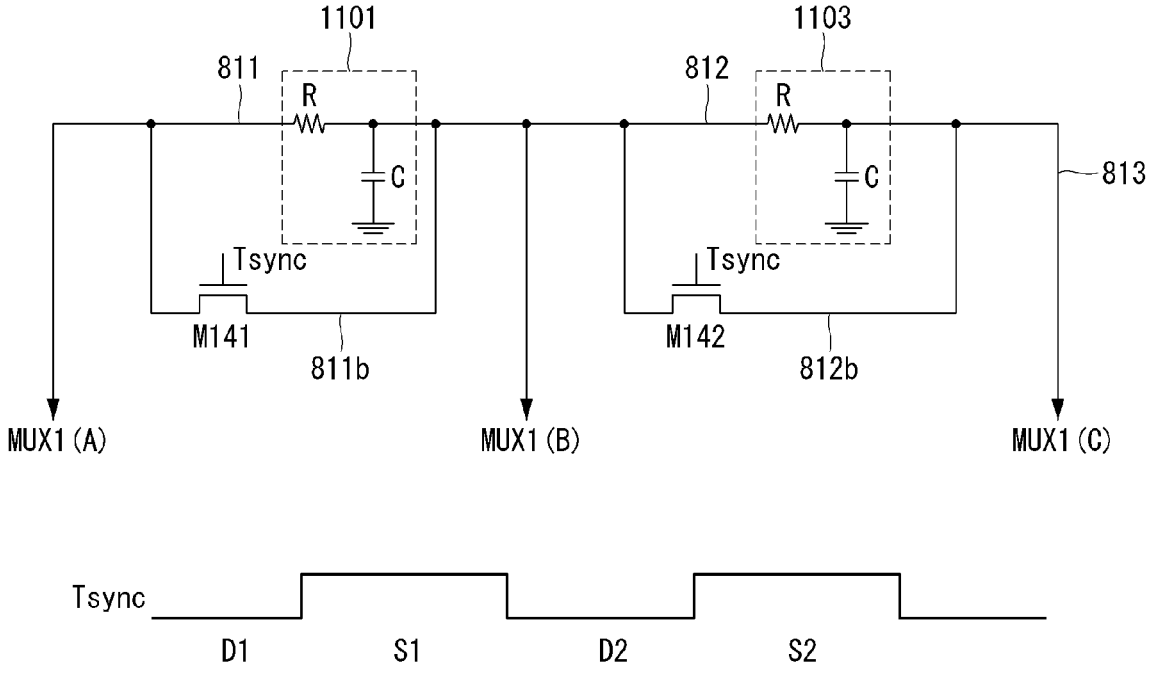
FIG. 14 is a circuit diagram showing bypass switching elements connected to two ends of the signal delay parts according to an example of the present disclosure.

In the present disclosure, as shown in FIG. 14, a bypass path that bypasses the signal delay parts 1101 to 1104 can be connected to the control signal lines 811 to 823, and the bypass path can be selectively turned on/off using switching elements on the bypass path. In the present disclosure, the switching elements on the bypass path can be turned on so that the switch control signals MUX1 and MUX2 are transmitted to all the demultiplexers MUXA, MUXB, and MUXC without delay.

FIG. 14 is a circuit diagram showing bypass switching elements M141 and M142 connected to two ends of the signal delay parts 1101 and 1103.

Referring to FIG. 14, the first control line comprises first bypass lines 811*b* connected to the (1-1)th and (1-2)th control signal lines 811 and 812 so as to be connected to two ends of the first signal delay part 1101, and second bypass lines 812*b* connected to the (1-2)th and (1-3)th control signal lines 812 and 813 so as to be connected to two ends of the third signal delay part 1103.

One end of the first bypass lines 811*b* is connected to the (1-1)th control signal line 811 through the bypass switching elements M141, and the other end of the first bypass lines 811*b* is connected to the (1-2)th control signal line 812. One end of the second bypass line 812*b* is connected to the (1-2)th control signal line 812 through the bypass switching elements M142, and the other end of the second bypass line 812*b* is connected to the (1-3)th control signal line 813.

The first control line comprises a first bypass switching element M141 that selectively connects the (1-1)th control line 811 and the (1-2)th control line 812 through the first bypass line 811*b* and a second bypass switching element M142 that selectively connects the (1-2)th control line 812 and the (1-3)th control line 813 through the second bypass line 812*b*.

The bypass switching elements M141 and M142 can be turned on and off in response to the synchronization signal Tsync from the timing controller 106. Like the first control line, the second control line omitted from the drawing can comprise bypass switching elements and bypass lines.

The bypass switching elements M141 and M142 can be used for various purposes. In an example, as shown in FIG. 14, the timing controller 106 can turn on the bypass switching elements M141 and M142 during a touch sensing period to transmit switching control signals MUX1(A) to MUX1(C) to control nodes of the demultiplexers MUXA, MUXB, and MUXC. In this case, in all the demultiplexers MUXA, MUXB, and MUXC, the first switching elements MA1, MB1, and MC1 are simultaneously turned on and off, and then the second switching elements MA2, MB2, and MC2 are simultaneously turned on and off.

A gate of the first bypass switching element M141 receives a synchronization signal Tsync. A first electrode of the first bypass switching element M141 is connected to the (1-1)th control line 811 via one side of the first bypass line 811*b*. A second electrode of the first bypass switching element M141 is connected to the (1-2)th control line 812 via the other side of the first bypass line 811*b*. The first bypass switching element M141 is turned on by the high level of the synchronization signal Tsync which defines the touch sensing periods S1 and S2, and connects the (1-1)th control line 811 to the (1-2)th control line 812. In this instance, the switch control signals MUX1(A) and MUX1(B) are simultaneously applied to the gates of the first switching elements MA1 and MB1 of the first and second demultiplexers MUXA and MUXB without delay.

A gate of the second bypass switching element M142 receives a synchronization signal Tsync. A first electrode of the second bypass switching element M142 is connected to the (1-2)th control line 812 via one side of the second bypass line 812*b*. A second electrode of the second bypass switching element M142 is connected to the (1-3)th control line 813 via the other side of the second bypass line 812*b*. The second bypass switching element M142 is turned on by the high level of the synchronization signal Tsync, and connects the (1-2)th control line 812 to the (1-3)th control line 813. In this instance, the switch control signals MUX1(B) and MUX1(C) are simultaneously applied to the gates of the first switching elements MB1 and MC1 of the second and third demultiplexers MUXB and MUXC without delay. A display device and method of driving the same according to various embodiments of the disclosure can be described as follows.

A display device includes a control signal generator that generates a control signal, a first demultiplexer configured to time-divide a data voltage from a first channel of a data driver and distribute the data voltage from the first channel to two or more data lines, in response to the control signal, a signal delay part configured to delay the control signal, and a second demultiplexer configured to time-divide a data voltage from a second channel of the data driver and distribute the data voltage from the second channel to other two or more data lines, in response to the control signal delayed by the signal delay part.

The first demultiplexer sequentially connects the first channel of the data driver to first and second data lines by using first and second switching elements, and the second demultiplexer sequentially connects the second channel of the data driver to third and fourth data lines by using third and fourth switching elements. The control signal includes a first switch control signal that controls the first and third switching elements, and a second switch control signal that controls the second and fourth switching elements.

The display further includes a (1-1)th control signal line that supplies the first switch control signal to a control node of the first switching element, a (1-2)th control signal line connected to a control node of the third switching element, a (2-1)th control signal line that supplies the second switch control signal to a control node of the second switching element, and a (2-2)th control signal line connected to a control node of the fourth switching element. The signal delay part includes a first signal delay part configured to be connected between the (1-1)th control signal line and the (1-2)th control signal line and delay the first switch control signal and supply a delayed first switch control signal to the (1-2)th control signal line, and a second signal delay part configured to be connected between the (2-1)th control signal line and the (2-2)th control signal line and delay the second switch control signal and supply a delayed second switch control signal to the (2-2)th control signal line.

The data driver comprises a plurality of driver ICs. The first channel is one of the channels in a first driver IC, and the second channel is one of the channels in a second driver IC.

The data lines and the demultiplexers are arranged on a substrate of a display panel comprising a pixel array, and the control signal lines and the signal delay parts are arranged on a printed circuit board electrically connected to the display panel.

The display device further includes a (1-1)th bypass line that connects the (1-1)th control signal line to the control node of the first switching element, a (1-2)th bypass line that connects the (1-2)th control signal line to the control node of the third switching element, a (2-1)th bypass line that connects the (2-1)th control signal line to the control node of the second switching element, and a (2-2)th bypass line that connects the (2-2)th control signal line to the control node of the fourth switching element.

The data lines are connected to pixels to which pixel data is written during a display period, the first and second switching elements are alternately turned on and off in every horizontal period, and the third and fourth switching elements are alternately turned on and off in every horizontal period.

The display device further includes a display panel comprising sensor lines that are connected to touch sensors, along with the data lines, and a touch sensor driver configured to supply a signal to the sensor lines to drive the touch sensors.

One frame period is time-divided into one or more display periods and one or more touch sensing periods. The data driver outputs a data voltage during the display period, and the touch sensor driver drives the touch sensors during the touch sensing period to amplify and integrate a signal from the touch sensors and convert the integrated value to digital data.

The first and second switching elements are alternately turned on and off in every horizontal period during the display period to distribute a data voltage received through the first channel to the first and second data lines, and then are kept in the on state after a stabilization time of the touch sensing period, and the third and fourth switching elements are alternately turned on and off in every horizontal period during the display period to distribute a data voltage received through the second channel to the third and fourth data lines, and then are kept in the on state after the stabilization time.

The touch sensor driver starts operating after the stabilization time.

A falling edge timing of the last switch control signal is within the stabilization time.

The display device further includes a first bypass line configured to selectively connect the (1-1)th control signal line and the (1-2)th signal line by using a first bypass switching element, and a second bypass line configured to selectively connect the (2-1)th control signal line and the (2-2)th signal line by using a second bypass switching element.

The first bypass switching element is turned on during the touch sensing period under control of the control signal generator to connect the (1-1)th control signal line and the (1-2)th signal line. The second bypass switching element is turned on during the touch sensing period under control of the control signal generator to connect the (2-1)th control signal line and the (2-2)th signal line.

A display device includes a first demultiplexer configured to time-divide a first and second data voltage sequentially outputted through a first channel of a data driver and distribute the first and second data voltage to first and second data lines, in response to a control signal, a second demultiplexer configured to time-divide a third and fourth data voltage sequentially outputted through a second channel of the data driver and distribute the third and fourth data voltage to third and fourth data lines, in response to a delayed version of the control signal, and a signal delay part configured to be connected between a first control signal line for transmitting the control signal and a second control signal line connected to a control node of the second demultiplexer and delay the control signal and apply the delayed control signal to the control node of the second demultiplexer.

A method of driving a display device includes generating a control signal for controlling the switch on/off timings of first and second demultiplexers, applying the control signal to a control node of the first demultiplexer and time-dividing a data voltage outputted through a first channel of a data driver and distributing the same to first and second data lines, delaying the control signal, and applying the delayed control signal to a control node of the second demultiplexer and time-dividing a data voltage outputted through a second channel of the data driver and distributing the same to third and fourth data lines.

As described above, the present disclosure can reduce EMI in the display device by using time differences in switch on/off timings between demultiplexers.

In the present disclosure, a load free driving signal of the same phase are applied to the gate lines and the sensor lines by controlling the switch on/off timings of the demultiplexers without time differences during a touch sensing period, thereby minimizing the effects of parasitic capacitance on a touch sensor driving signal.

Moreover, in the present disclosure, the touch sensor driver does not operate but is on standby during a stabilization time. Thus, the effect of the parasitic capacitance of the display panel 100 can be ignored.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a control signal generator that generates a control signal;

a first demultiplexer configured to time-divide a data voltage from a first channel of a data driver and distribute the data voltage from the first channel to two or more data lines, in response to the control signal;

a signal delay part configured to delay the control signal;

a second demultiplexer configured to time-divide a data voltage from a second channel of the data driver and distribute the data voltage from the second channel to other two or more data lines, in response to the control signal delayed by the signal delay part; and a control signal transmission line configured to be connected to the control signal generator, the signal delay unit, the first demultiplexer, and the second demultiplexer, wherein the control signal transmission line includes:

a first closed-loop line configured to supply the control signal to a control node of the first demultiplexer; and a second closed-loop line configured to supply the control signal delayed by the signal delay part to a control node of the second demultiplexer.

2. The display device of claim 1, wherein the first demultiplexer sequentially connects the first channel of the data driver to first and second data lines by using first and second switching elements, and the second demultiplexer sequentially connects the second channel of the data driver to third and fourth data lines by using third and fourth switching elements, wherein the control signal comprises:

a first switch control signal that controls the first and third switching elements; and a second switch control signal that controls the second and fourth switching elements.

3. The display device of claim 2, wherein the control signal transmission line further includes:

a (1-1)th control signal line that supplies the first switch control signal to a control node of the first switching element;

a (1-2)th control signal line connected to a control node of the third switching element;

a (2-1)th control signal line that supplies the second switch control signal to a control node of the second switching element; and a (2-2)th control signal line connected to a control node of the fourth switching element, wherein the signal delay part comprises:

a first signal delay part configured to be connected between the (1-1)th control signal line and the (1-2)th control signal line, and delay the first switch control signal and supply a delayed first switch control signal to the (1-2)th control signal line; and a second signal delay part configured to be connected between the (2-1)th control signal line and the (2-2)th control signal line, and delay the second switch control signal and supply a delayed second switch control signal to the (2-2)th control signal line.

4. The display device of claim 3, wherein the data driver comprises a plurality of driver ICs including a first driver IC and a second driver IC, wherein the first channel is one of channels in the first driver IC, and the second channel is one of channels in the second driver IC.

5. The display device of claim 3, wherein the data lines and the demultiplexers are arranged on a substrate of a display panel comprising a pixel array, and the control signal lines and the signal delay parts are arranged on a printed circuit board electrically connected to the display panel.

6. The display device of claim 3, where in the first closed-loop line includes:

a (1-1)th bypass line that connects the (1-1)th control signal line to the control node of the first switching element; and a (2-1)th bypass line that connects the (2-1)th control signal line to the control node of the second switching element, the second closed-loop line including:

a (1-2)th bypass line that connects the (1-2)th control signal line to the control node of the third switching element;

a (2-2)th bypass line that connects the (2-2)th control signal line to the control node of the fourth switching element.

7. The display device of claim 3, wherein the data lines are connected to pixels to which pixel data is written during a display period, the first and second switching elements are alternately turned on and off in every horizontal period, and the third and fourth switching elements are alternately turned on and off in every horizontal period.

8. The display device of claim 3, further comprising:

a display panel comprising sensor lines that are connected to touch sensors, along with the data lines; and a touch sensor driver configured to supply a signal to the sensor lines to drive the touch sensors.

9. The display device of claim 8, wherein one frame period is time-divided into one or more display periods and one or more touch sensing periods, wherein the data driver outputs a data voltage during the display period, and the touch sensor driver drives the touch sensors during the touch sensing period to amplify and integrate a signal from the touch sensors and convert the integrated value to digital data.

10. The display device of claim 9, wherein the first and second switching elements are alternately turned on and off in every horizontal period during the display period to distribute a data voltage received through the first channel to the first and second data lines, and then are kept in the on state after a stabilization time of the touch sensing period, and the third and fourth switching elements are alternately turned on and off in every horizontal period during the display period to distribute a data voltage received through the second channel to the third and fourth data lines, and then are kept in the on state after the stabilization time.

11. The display device of claim 10, wherein the touch sensor driver starts operating after the stabilization time.

12. The display device of claim 11, wherein a falling edge timing of the last switch control signal is within the stabilization time.

13. The display device of claim 9, further comprising:

a first bypass line configured to selectively connect the (1-1)th control signal line and the (1-2)th control signal line by using a first bypass switching element; and a second bypass line configured to selectively connect the (2-1)th control signal line and the (2-2)th control signal line by using a second bypass switching element.

14. The display device of claim 13, wherein the first bypass switching element is turned on during the touch sensing period under control of the control signal generator to connect the (1-1)th control signal line and the (1-2)th control signal line, and the second bypass switching element is turned on during the touch sensing period under control of the control signal generator to connect the (2-1)th control signal line and the (2-2)th control signal line.

15. The display device of claim 3, wherein the first closed-loop line includes:

a (1-1)th closed-loop line configured to connect the (1-1)th control signal line to the control node of the first switching element; and a (2-1)th closed-loop line configured to connect the (2-1) th control signal line to the control node of the second switching element, wherein the second closed-loop line including:

a (1-2)th closed-loop line configured to connect the (1-2) th control signal line to the control node of the third switching element; and a (1-2)th closed-loop line configured to connect the (2-2) th control signal line connected to the control node of the fourth switching element.

16. The display device of claim 15, wherein the first switch control signal is supplied to the control node of the first switching element through the (1-1)th closed-loop line, wherein the delayed first switch control signal output from the first signal delay part is supplied to the control node of the third switching element through the (1-2)th closed-loop line, wherein the second switch control signal is supplied to the control node of the second switching element through the (2-1)th closed-loop line, wherein the delayed second switch control signal output from the second signal delay part is supplied to the control node of the fourth switching element through the (2-2)th closed-loop line.

17. The display device of claim 16, wherein a pulse of the first switch control signal, a pulse of the delayed first switch control signal, a pulse of the second switch control signal, and a pulse of the delayed second switch control signal are generated within one horizontal period, wherein a time between a rising edge of an earliest pulse of the pulses and a falling edge of a latest pulse of the pulses is less than the one horizontal period.

18. A display device comprising:

a first demultiplexer configured to time-divide a first data voltage and a second data voltage sequentially outputted through a first channel of a data driver, and distribute the first and second data voltages to first and second data lines, in response to a control signal;

a second demultiplexer configured to time-divide a third data voltage and a fourth data voltage sequentially outputted through a second channel of the data driver, and distribute the third and fourth data voltages to third and fourth data lines, in response to a delayed version of the control signal;

a signal delay part configured to be connected between a first control signal line for transmitting the control signal and a second control signal line connected to a control node of the second demultiplexer, and delay the control signal and apply the delayed control signal to the control node of the second demultiplexer; and a control signal transmission line configured to be connected to the first demultiplexer, the second demultiplexer, and the signal delay unit, wherein the control signal transmission line including:

a first closed-loop line configured to supply the control signal to a control node of the first demultiplexer; and a second closed-loop line configured to supply the control signal delayed by the signal delay part to a control node of the second demultiplexer.

19. A method of driving a display device, the method comprising: generating a control signal for controlling switch on/off timings of first and second demultiplexers; applying the control signal to a control node of the first demultiplexer through a first closed-loop line and time-dividing a data voltage outputted through a first channel of a data driver and distributing the same to first and second data lines; delaying the control signal; and applying the delayed control signal to a control node of the second demultiplexer through a second closed-loop line and time-dividing a data voltage outputted through a second channel of the data driver and distributing the same to third and fourth data lines.

* * * * *